US005388832A

United States Patent [19]

Hsu

[11] Patent Number: 5,388,832

[45] Date of Patent: Feb. 14, 1995

[54] PRACTICE-TYPE GOLF PUTTER

[76] Inventor: Kuo H. Hsu, 2Fl., No. 57, Lane 60, Chunghua Rd., Hsintien City, Taipei Hsien, Taiwan, Prov. of China

[21] Appl. No.: 243,688

[22] Filed: May 18, 1994

[51] Int. Cl.[6] ..... A63B 69/36

[52] U.S. Cl. ..... 273/186.3; 273/194 A; 273/163 R

[58] Field of Search ..... 273/191 R, 192, 193 R, 273/194 R, 194 A, 186.1, 186.2, 186.3, 185 R, 187.4, 187.6, 164.1, 163 R, 187.2, 183.1, 181 H; 434/252; 33/334, 508; 362/287, 390, 427, 369, 370

[56] References Cited

U.S. PATENT DOCUMENTS

| | | | |
|---|---|---|---|
| 2,787,470 | 4/1957 | Barrus | 273/186.3 |
| 3,677,553 | 7/1972 | Moore | 273/186.3 |
| 3,820,795 | 6/1974 | Taylor | 273/186.3 |
| 4,911,450 | 3/1990 | Rabold | 273/186.3 |
| 5,193,812 | 3/1993 | Hendricksen | 273/186.3 |
| 5,205,643 | 4/1993 | Lin | 362/427 |
| 5,207,429 | 5/1993 | Walmsley | 273/186.2 |
| 5,213,331 | 5/1993 | Avanzini | 273/186.3 |
| 5,330,188 | 7/1994 | Reimers | 273/183.1 |

*Primary Examiner*—Sebastiano Passaniti

*Attorney, Agent, or Firm*—Poms, Smith, Lande & Rose

[57] ABSTRACT

A practice-type golf putter includes a grip connected to a shaft connected to a neck connected to a head. The grip defines a space therein for receiving batteries. The shaft and the neck are hollow structures for receiving a pair of wires. A switch is bridged between the batteries and the wires and allowed to be turned on to electrically connect the batteries to the wires. The head includes a curved plate having a wall extending upward from one side thereof for hitting a golf ball, a socket mounted on the curved plate and having a body portion and a U-shaped bracket integrally formed at a top of the body portion, a receptacle including two beams extending oppositely and laterally from a periphery thereof for, pivotal connection to two upright walls of the U-shaped bracket, a laser radiator having a first end received in the receptacle and electrically connected to the wires which extend from the neck of the putter and a second end protruding beyond the receptacle for emitting laser light when the switch is turned on, and a sleeve cover having a first end engaged to the receptacle and a second end having a hole allowing laser light to emit therefrom.

4 Claims, 4 Drawing Sheets

PRACTICE-TYPE GOLF PUTTER

BACKGROUND OF THE INVENTION

1. Field of the Invention

The present invention relates to a practice-type golf putter, and more particularly to one which employs a laser radiator allowing a user to practice aiming at a hole.

2. Description of the Prior Art

Golf is a very popular sport at the present time. For beginners, the most requisite skill is to discipline themselves to aim a hole and putt the ball into the hole in the correct direction and with appropriate force. It is requisite to provide a new golf putter which has an auxiliary device such as a laser indicator installed on the putter for aiding a user to aim at the hole.

SUMMARY OF THE INVENTION

The primary objective of the present invention is to provide a practice-type golf putter which can emit laser light from a head thereof and the projecting direction of the laser light is adjustable thus aiding a user to precisely hole a golf ball thus he or she can gain confidence in his/her ability.

In accordance with one aspect of the invention, there is provided a practice-type golf putter comprising a grip connected to a shaft connected to a neck connected to a head. The grip defines space therein for receiving batteries. The shaft and the neck are hollow structures for receiving a pair of wires. A switch is bridged between the batteries and the wires and allowed to be operated on to electrically connect the batteries to the wires. The head comprises a curved plate including a wall extending upward from one side thereof for hitting a golf ball, a socket mounted on the curved plate and having a body portion and a U-shaped bracket integrally formed at a top of the body portion, a receptacle including two beams extending oppositely and laterally from a periphery thereof for pivotal connection to two upright walls of the U-shaped bracket, a laser radiator received in the receptacle having a first end electrically connected to the wires which extends from the neck and a second end protruding beyond the receptacle for emitting laser light when the wires are electrically connected to the batteries, and a sleeve cover including a first end engaged to the receptacle and a second end defining a hole allowing laser light to emit therefrom.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
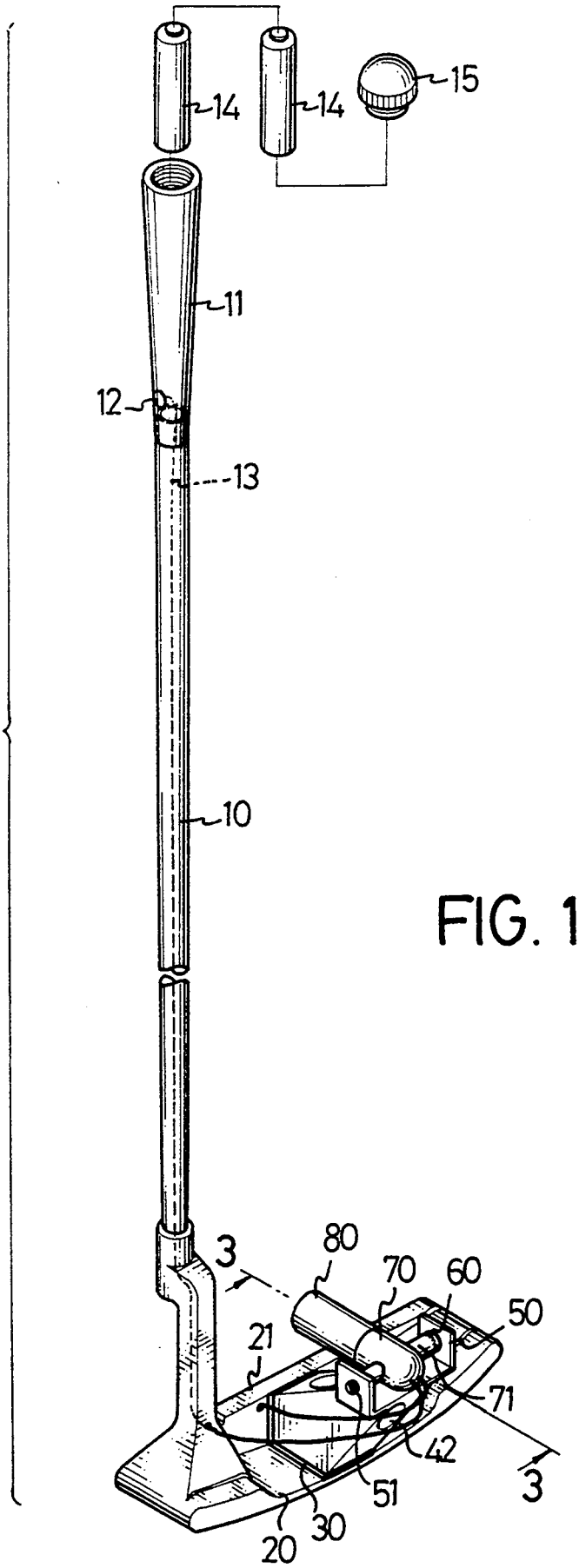
FIG. 1 is a perspective view of a practice-type golf putter in accordance with the present invention, where two batteries and a cover are separated for illustrative purpose.

Referring to the drawings and initially to FIG. 1, a practice-type golf putter in accordance with the present invention comprises a grip 11 connected to a shaft 10 connected to a neck 16 connected to a head 2. The grip 11 is a conical hollow structure defining space therein for receiving batteries 14. A cover 15 is used to cover an opening of the grip. 11. The shaft 10 is a tube for receiving a pair of wires 13 which is electrically connected to a switch 12 installed in an interconnection between the grip 11 and the shaft 10. The neck 16 is hollow for receiving a portion of the wires 13. The batteries 14, when positioned in the space of the grip 11 are electrically connected to the switch 12. The pair of wires 13 are electrically connected to the batteries 14 when the switch 12 is manually turned on.

Figure 2:
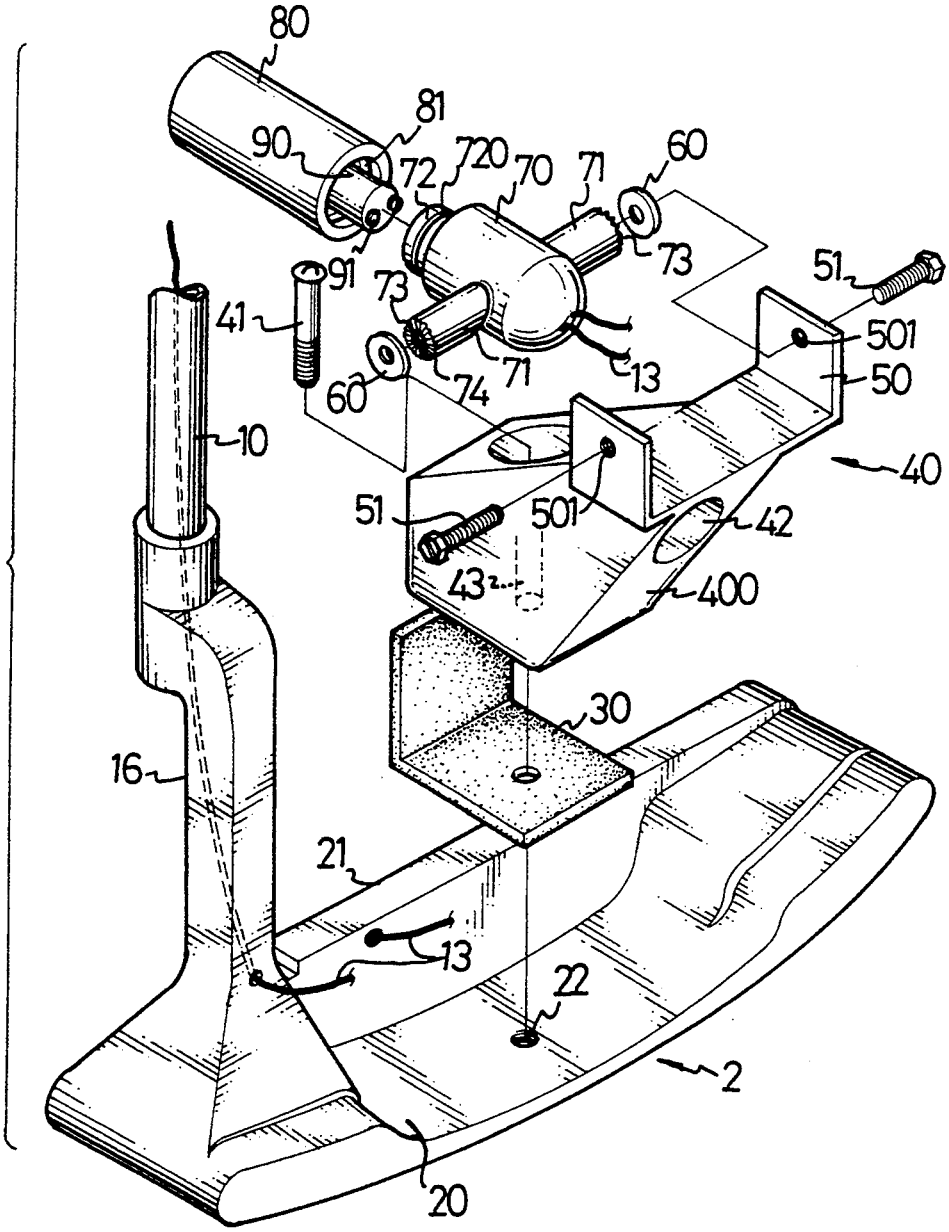
FIG. 2 is an exploded view of FIG. 1, with most of a shaft portion of the practice-type golf putter being omitted.

Referring to FIG. 2, the head 2 comprises a curved plate 20 having a wall 21 extending upward from one side thereof for hitting a golf ball (not shown). A threaded hole 22 is formed substantially at a central part of the curved plate 20. A socket 40 includes a body portion 400, a U-shaped bracket 50 integrally formed at a top of the body portion 400, a first hole 42 defined horizontally through the body portion 400, a second hole 43 defined vertically through the body portion 400 and having an axis substantially perpendicular to an axis of the hole 42. A screw 41 through the holes 43 and 22 is used to secure the body portion 400 of the socket 40 to the curved plate 20. An L-shaped rubber washer 30 having a hole allowed to be passed through by the screw 41 is buffered between the socket portion 400 and the curved plate 20 for absorbing shock to the socket 40 when a user hits a golf ball at the wall 21.

Two threaded holes 501 are defined at two upright walls of the U-shaped bracket 50. A receptacle 70 includes two beams 71 in alignment with each other extending laterally from periphery thereof and a neck 72 extending longitudinally therefrom and an opening is defined at one end of the neck 72. An annular groove 720 is defined around periphery of the neck 72. Each beam 71 has a hole 74 therein such that two screws 51 are allowed to pivotally secure the two beams 71 to two holes 501 of the U-shaped bracket 50. Each beam 71 has at one end thereof a plurality of teeth 73 for increasing the retaining effect between the receptacle 70 and the bracket 40 when a user wants to position the receptacle 70 at a preferred angle with respect to an axis defined by the two beams 71 (see FIG. 3). Two rubber washers 60 each are engaged between corresponding teeth 73 of the beam 71 and a corresponding upright wall of the U-shaped bracket 50 for absorbing shock when the head 20 hits a golf ball.

A laser radiator 90 formed as a cylinder has a first end received in the receptacle 70 and a second end protruding beyond the opening of the neck 72 of the receptacle 70. The laser radiator 90 has two pins 91 protruding from the first end thereof for receiving a DC power supply from the wires 13 which extend from the neck 16 of the putter and penetrate to a bottom of the receptacle 70 via two holes (not labeled) thereof. Two conductive contacts (not shown) are formed in the receptacle 70 for connecting the wires 13 and the pins 91 of the laser radiator 90. The laser radiator 90 has a second end thereof for emitting laser light. A sleeve 80 adapted to mate with an outer periphery of the neck 72 of the receptacle 70 has an inner protrusion 81 adapted to engage with the annular groove 720 of the neck 72 of the receptacle 70. The sleeve 80 engages to the neck 72 and also encloses the laser radiator 90. A hole 82 (see FIG. 3) is formed at one end of the sleeve 80 allowing laser light from the laser radiator 90 to emit therefrom.

Figure 3:
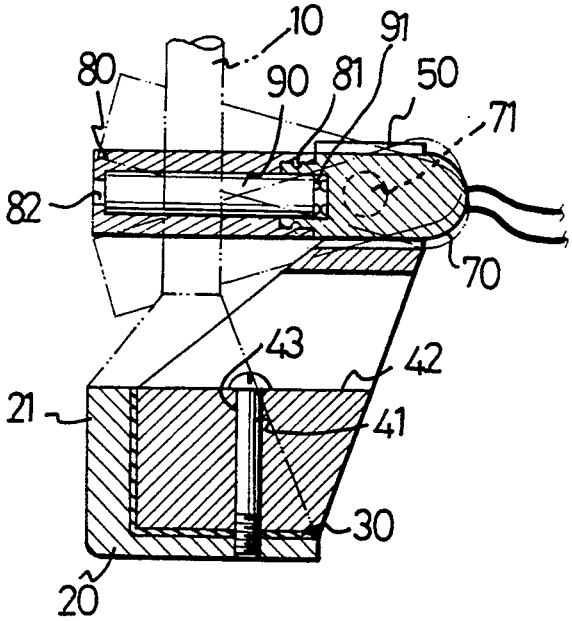
FIG. 3 is a cross-sectional view taken from a line 3—3 of FIG. 1.
Figure 4:
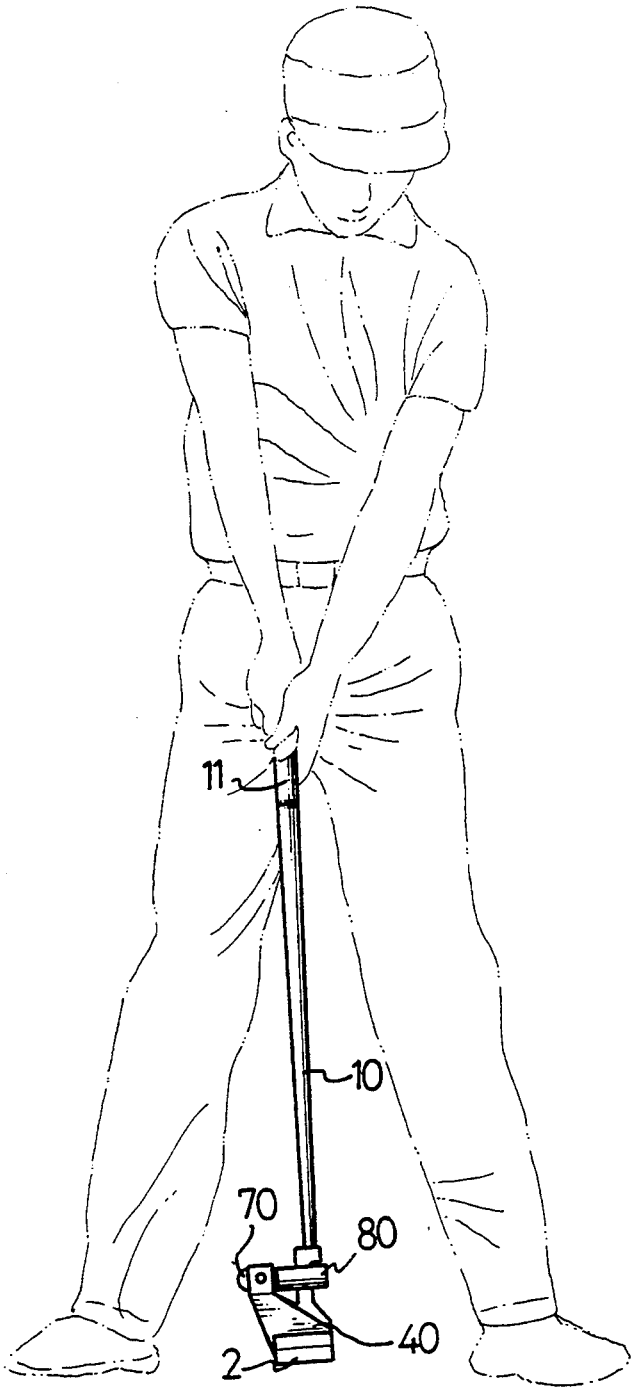
FIG. 4 illustrates a user holding the practice-type golf putter of the present invention.

Referring to FIGS. 3 and 4, a user can turn on the switch 12 and pivotally adjust the receptacle 70 at an optimum angle with respect to the axis of the two beams 71 allowing laser light from the laser radiator 90 to project to a hole precisely thus aiding the user to putt the golf ball. The user can gain confidence in putting a ball by means of this practice-type golf putter.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A practice-type golf putter comprising a grip connected to a shaft connected to a neck connected to a head, said grip defining a space therein for receiving batteries, said shaft and said neck being hollow structures for receiving a pair of wires;

a plurality of batteries;

at least one pair of wires;

a switch being bridged between said batteries and said wires and allowed to be operated in an on position to electrically connect said batteries to said wires;

said head comprising a curved plate having a wall extending upwardly from one side thereof for hitting a golf ball, a socket having a body portion and a U-shaped bracket having two upright walls integrally formed at a top of said body portion, said body portion being mounted on said curved plate, a receptacle including two beams extending oppositely and laterally from a periphery thereof for pivotal connection to said two upright walls of said U-shaped bracket, a laser radiator including a first end received in said receptacle and electrically connected to said wires which extend from said neck and a second end protruding beyond said receptacle for emitting laser light when said wires are electrically connected to said batteries, and a sleeve cover having a first end engaged to said receptacle and a second end having a hole allowing laser light from said laser radiator to emit therefrom.

2. A practice-type golf putter as claimed in claim 1, wherein each of said beams of said receptacle has teeth at one end thereof for an increased retaining effect with a corresponding one of said upright walls of said U-shaped bracket.

3. A practice-type golf putter as claimed in claim 1 further comprising a pair of washers each positioned between one end of each of said beams and each of said upright wall of said U-shaped bracket for absorbing shock when said wall of said head hits a golf ball.

4. A practice-type golf putter as claimed in claim 1 further comprising an L-shaped washer positioned between said body portion of said socket and said curved plate for absorbing shock when said wall of said head hits a golf ball.

* * * * *